US007501032B1

(12) United States Patent
Noebe et al.

(10) Patent No.: US 7,501,032 B1
(45) **Date of Patent: *Mar. 10, 2009**

(54) HIGH WORK OUTPUT NI-TI-PT HIGH TEMPERATURE SHAPE MEMORY ALLOYS AND ASSOCIATED PROCESSING METHODS

(75) Inventors: Ronald D. Noebe, Medina, OH (US); Susan L. Draper, Westlake, OH (US); Michael V. Nathal, Strongsville, OH (US); Anita Garg, Westlake, OH (US)

(73) Assignee: The United States of America as represented by the Administration of NASA, Washington, DC (US)

( * ) Notice: Subject to any disclaimer, the term of this patent is extended or adjusted under 35 U.S.C. 154(b) by 296 days.

This patent is subject to a terminal disclaimer.

(21) Appl. No.: 11/364,283

(22) Filed: Feb. 28, 2006

(51) Int. Cl.
*C22C 30/00* (2006.01)

(52) U.S. Cl. ..... 148/402; 148/442

(58) Field of Classification Search ..... 148/402
See application file for complete search history.

(56) References Cited

U.S. PATENT DOCUMENTS 4,865,663 A 9/1989 Tuominen et al.
5,114,504 A 5/1992 AbuJudom, II et al.
5,641,364 A 6/1997 Goldberg et al.
5,948,184 A * 9/1999 Frantzen et al. ..... 148/563
6,149,742 A * 11/2000 Carpenter et al. ..... 148/563
6,454,913 B1 9/2002 Rasmussen et al.
6,669,795 B2 12/2003 Johnson et al.
7,316,753 B2 * 1/2008 Jung et al. ..... 148/402
2002/0189719 A1 12/2002 Rasmussen et al.
2003/0168334 A1 9/2003 Rasmussen et al.

OTHER PUBLICATIONS

NASA Technical Reports Server (NTRS) Webpage regarding Properties and Potential of Two (Ni,Pt) Ti Alloys for use as High-Temperature Materials, by Noebe et al.*
K. Otsuka and X. Ren, Progress in Materials Science 50 (2005) 511-678.
C. Mavroidis, Res Nondestr Eval (2002) 14: 1-32.
Lindquist, "Structure and Transformation Behavior of Martensitic Ti-(Ni,Pd) Ti-(Ni,Pt) Alloys", Thesis, University of Illinois, 1978.
Wu, "Interstitial Ordering and Martensitic Tranformation of Titanium-Nickel-Gold Alloys", Thesis, University of Illinois, 1986.
R. Noebe, et al., Properties and Potential of Two (Ni,Pt) Ti Alloys for Use as High-Temperature Actuator Materials, SPIE Conf. Proc. vol. 5761, (2005), pp. 364-375.

* cited by examiner

*Primary Examiner*—George Wyszomierski
(74) *Attorney, Agent, or Firm*—Howard M. Cohn

(57) ABSTRACT

According to the invention, compositions of Ni—Ti—Pt high temperature, high force, shape memory alloys are disclosed that have transition temperatures above 100° C.; have narrow hysteresis; and produce a high specific work output.

12 Claims, 5 Drawing Sheets

HIGH WORK OUTPUT NI-TI-PT HIGH TEMPERATURE SHAPE MEMORY ALLOYS AND ASSOCIATED PROCESSING METHODS

STATEMENT REGARDING FEDERALLY SPONSORED RESEARCH OR DEVELOPMENT

The invention described herein was made by employees of the United States Government and may be manufactured and used by or for the Government for Government purposes without the payment of any royalties thereon or therefore.

FIELD OF THE INVENTION

The present invention relates generally to shape memory alloys, and more particularly to Titanium-Nickel-Platinum shape memory alloys.

BACKGROUND OF THE INVENTION

Nickel Titanium (NiTi) alloys are known in the prior art. They display excellent shape memory behavior and possess outstanding specific work output, along with other unusual properties such as superelastic behavior as disclosed in K. Otsuka and X. Ren, Prog. Maters, Sci. 50 (2005) 511, good damping behavior, and erosion and wear resistance. However, their practical usage range does not exceed approximately 60° C., which is the maximum martensite start temperature ($M_s$) observed in binary alloys. They are often marketed as "Nitinol", and are used as connectors, couplings, valves, seals, coatings, actuators, and in various medical and dental devices. Their Ni/Ti content ranges from approximately 48.5/51.5 atom % to approximately 51/49 atom %.

The unique behavior of NiTi and related shape memory alloys is based on the reversible temperature-dependent austenite-to-martensite phase transformation. They can easily be deformed from an initial shape to another while in their lower temperature form (martensite). Upon heating through the phase transformation to austenite, they revert back to their original shape. This reversible behavior is the basis for such properties as shape memory effect and superelasticity and is the foundation for many practical applications. In addition, a subset of the alloys that display shape memory behavior can recover their original shape even when a substantial opposing force is applied to the material. In this way, the alloy is capable of performing work and can act as a solid state actuator. NiTi, in particular, is capable of specific work output with equivalent or higher energy density than pneumatic actuators or D.C. motors, see C. Mavroidis, res Nondestr. Eval. 14 (2002) 1.

The reversible transformation of Ni—Ti shape memory alloys occurs over two slightly different temperature ranges: one range during heating and the other during cooling. These temperature ranges are characteristic of the specific alloy and dependent on alloy composition and processing history. When shape memory alloys are heated they will change from their martensite form to austenite. The temperature at which this transformation starts is the austenite start temperature ($A_s$) and the temperature at which this transformation from martensite to austenite is complete is called the austenite finish temperature ($A_f$). When the alloy is cooled from high temperature, the transformation is reversed and the austenite will begin transforming to martensite at the martensite start temperature ($M_s$) and will be completely converted to martensite at the martensite finish temperature ($M_f$). Therefore, these transformation temperatures determine over what temperature range the shape memory and other effects can be observed. For NiTi, the maximum $M_s$ temperature is observed in stoichiometric Ni-50 at, % Ti and Ti-rich NiTi alloys and is about 60° C., as disclosed in Otsuka and Ren, *Prog. Mater. Sci.* 50 (2005) 511.

The temperature range for the martensite-to-austenite transformation that takes place on heating is somewhat higher than that for the reverse transformation on cooling. The difference between the transition temperatures on heating and cooling is referred to as the hysteresis and is usually defined as the difference between the $A_f$ and $M_s$ temperatures. For NiTi alloys, this difference is on the order of 20° C.-30° C. (Otsuka and Ren, *Prog. Mater. Sci.* 50 (2005) 511). When developing shape memory alloys for actuator applications where active control of the material is desired, or for applications involving a quick response time, the hysteresis should be as narrow as possible.

Thus, while the unique behavior of NiTi is widely exploited in applications near room temperature, the uses for a material with properties similar to Ni—Ti, but capable of:

1. being used at elevated temperatures (greater than 100° C.),
2. having low hysteresis, and
3. high specific work output would open up new applications for shape memory alloys, particularly in the aerospace, automotive, automation and controls, appliance, energy, chemical processing, heating and ventilation, safety and security, and electronics (MEMS devices) industries.

Alloying additions to NiTi are well known and are primarily used to affect changes in the transformation temperatures of the resulting material: either to increase or decrease the transformation temperatures or change the width of the hysteresis. For example, Fe or Co substituted for Ni; or Al, Mn, V, or Cr substituted for Ti will severely decrease the transformation temperatures of the resulting ternary alloys. Cu has relatively little effect on the transformation temperatures but it can significantly reduce the hysteresis. Nb, on the other hand, broadens the hysteresis. There is also a group of alloying additions (Pd, Pt, Au, Hf, and Zr) that can raise the transformation temperatures of NiTi. Current proposed alloying schemes involve either substitution of a precious metal for Ni, e.g., (Ni,Pd)Ti, (Ni,Pt)Ti, (Ni,Au)Ti as described by Lindquist, in "*Structure and Transformation Behavior of Martensitic* Ti—(Ni,Pd) *and* Ti—(Ni,Pt) *Alloys*", Thesis, University of Illinois, 1978 and Wu, "*Interstitial Ordering and Martensitic Transformation of Titanium-Nickel-Gold Alloys*", Thesis, University of Illinois 1986), or substitution of a reactive element like Hf or Zr for Ti, e.g., Ni(Ti,Hf) and Ni(Ti,Zr), (as claimed by AbuJudom, II et al., U.S. Pat. No. 5,114,504). However, the available literature does not report data for an alloy that exhibits a high transformation temperature with narrow hysteresis and demonstrated high work output.

Ni—Pt—Ti (20/30/50 atom %) alloys (R. Noebe, et al., SPIE Conf. Proc. Vol. 5761, (2005), pp. 364-375) have a high transition temperature but do not have sufficient work output to be used as acceptable actuators. Of the high-temperature ternary NiTi-based systems, useful work characteristics have only been verified in Ni(Ti,Hf) thin films by Rasmussen et al. (U.S. Pat. No. 6,454,913 and Patent Pub. No. US2002/01 8971 9A1). However, these Ni(Ti,Hf) alloys can only be used in applications requiring repeated actuation at temperatures up to about 100° C. because their wide hysteresis results in an $M_f$ near or below 100° C. There is little chance of increasing their use temperature (transformation temperature) by further increasing the Hf level due to microstructural limitations. The wide hysteresis of the Ni(Ti,Hf) alloys also makes them unsuitable for applications where active control is involved. To our knowledge, work measurements have not been made public on any of the other potential high-temperature NiTi-based systems.

Methods for processing high temperature shape memory alloys (HTSMA) have also been described in the literature. Tuominen, et al. (U.S. Pat. No. 4,865,663 claimed a series of (Ni,Pd)Ti—B alloys for increased fabricability. Goldberg et al. (U.S. Pat. No. 5,641,364) have claimed a method for manufacturing and heat treating (Ni,Pd)Ti, Ni(Ti,Zr) and Ni(Ti,Hf) alloys for improved shape recovery characteristics. A patent has also been applied for the method of producing (Ni,Pd)Ti thin films by magnetron sputtering (Rasmussen et al., US patent Pub. No. 2003/0168334). None of these references discuss shape recovery for alloys under load or provide any other indication of the work output for any of the materials discussed.

Lindquist ("*Structure and Transformation Behavior of Martensitic* Ti—(Ni,Pd) *and* Ti—(Ni,Pt) *Alloys*," Thesis, University of Illinois, 1978) reported the effect of Pt additions on the transformation temperature of "stoichiometric alloys" of (Ni+Pt):Ti. These alloys contain exactly 50 atom percent Ti. Lindquist studied Pt contents ranging from 0 to 30 atom % and demonstrated a significant increase in transformation temperatures when the Pt content was between 10 and 30 atom %. Lindquist found that alloys with 20 atom % Pt were capable of unconstrained shape memory behavior but made no attempt to measure the shape recovery of the material against any biasing force so no indication of the potential work output for the material was determined. Johnson et al. (U.S. Pat. No. 6,669,795) described a method for making HTSMA thin films using multiple sputtering targets where the goal was to create an alloy that has a 1:1 atomic ratio of (Ni+X):Ti or Ni:(Ti+Y) where X is an element from the right side of the periodic table such as Pd, Pt, Au, or Cu and Y is an element from the left side of the periodic table such as Hf or Zr. However, no alloys were actually produced nor were any properties reported.

Thus, a viable shape memory alloy for high temperature applications, particularly for actuator-related functions, has yet to be developed.

SUMMARY OF THE INVENTION

According to the present invention, there is disclosed a shape memory alloy consisting essentially of shape memory alloy compositions consisting essentially of from about 50 atomic % to about 52 atomic % of Ti, approximately 10 atomic % to 25 atomic % of Pt, and the balance of Ni. More preferably, the Ti content is approximately 50 atomic % to about 50.5 atomic % and the Pt content is approximately 15 atomic % to about 23 atomic %. Most preferably, the Ti content is approximately 50.3 atomic % to about 50.6 atomic % and the Pt content is approximately 18.5 atomic % to about 21 atomic %.

Further according to the invention, the Ti—Pt—Ni compositions include less than about 5 atomic % of one or more metals from the group consisting of Au, Pd and Cu wherein the one or more metals would replace a corresponding amount of Ni.

Still further according to the invention, the Ti—Pt—Ni compositions include less than about 2 atomic % of C wherein the C would replace a corresponding amount of Ni. Preferably the Ti—Pt—Ni compositions include less than about 2% of C wherein the C would replace a corresponding amount of Ni. More preferably the Ti—Pt—Ni compositions include between about 0.5 atomic % to about 1.0 atomic % C.

Also according to the invention, the Ti—Pt—Ni compositions include a Ti content that is approximately 50 atomic % to about 50.5 atomic % and the Pt content is approximately 15 atomic % to about 23 atomic %.

Further according to the invention, the shape memory alloy compositions have a transition temperature that is between about 100° C. and about 400° C. Preferably, the transition temperature is between about 200° C. and about 350° C.

Still further according to the invention, the Ti—Pt—Ni compositions have a hysteresis of less than about 50° C. Preferably, the hysteresis is less than about 20° C. Most preferably the hysteresis is between about 10° C. and about 20° C.

According to the present invention, the maximum work output of the shape memory alloy compositions is at least about 5 J/cm$^3$ and preferably greater than about 10 J/cm$^3$ and most preferably between about 10 J/cm$^3$ and about 15 J/cm$^3$.

According to the invention, various articles that utilize the shape memory behavior are made from the disclosed shape memory alloy. The disclosed shape memory alloy of the present invention are particularly useful because they have the following unique and useful combination of properties: (1) They can be used at elevated temperatures above 100° C.; (2) They have low hysteresis; and (3) They are capable of producing a high specific work output.

BRIEF DESCRIPTION OF THE FIGURES

The structure, operation, and advantages of the present invention will become apparent upon consideration of the description herein below taken in conjunction with the accompanying FIGURES. The FIGURES are intended to be illustrative, not limiting. Certain elements in some of the FIGURES may be omitted, or illustrated not-to-scale, for illustrative clarity.

Although the invention is generally described in the context of these preferred embodiments, it should be understood that the FIGURES are not intended to limit the spirit and scope of the invention to these particular embodiments.

Figure 1:
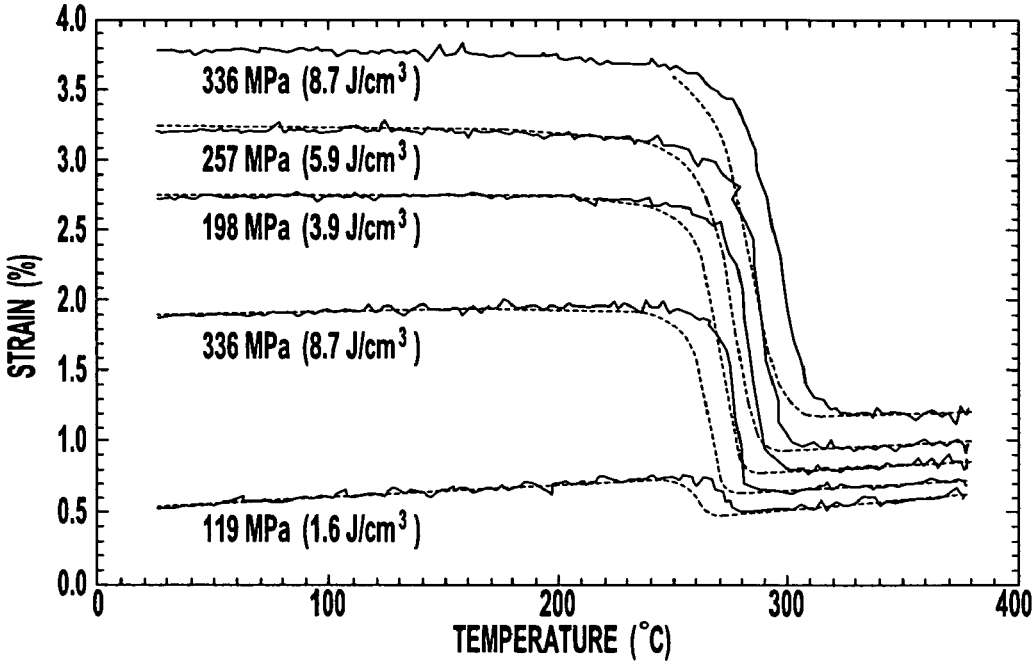

The structure, operation, and advantages of the present preferred embodiment of the invention will become further apparent upon consideration of the following description taken in conjunction with the accompanying FIGURES, wherein:

FIG. 1 is a curve showing strain versus temperature behavior under various constant stress levels for an arc melted nominally Ti-30Ni-20Pt alloy.

Figure 2:
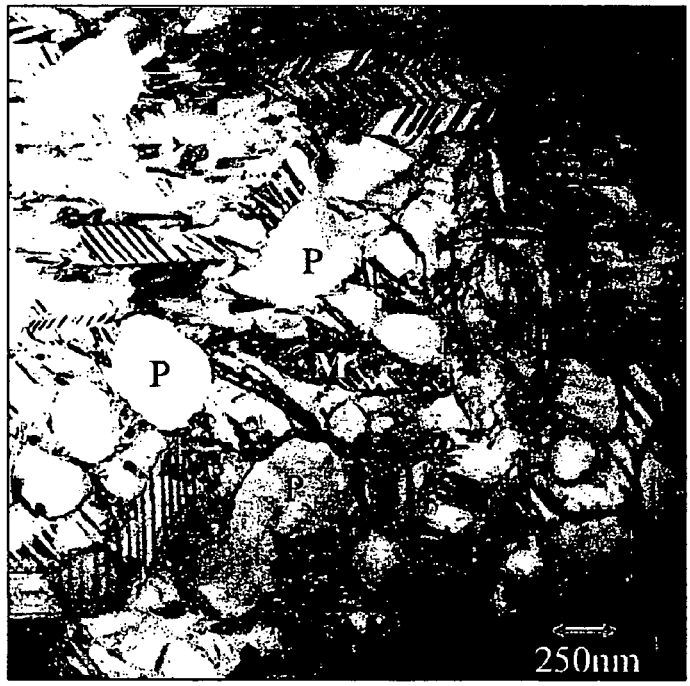

FIG. 2 is a transmission electron micrograph of sub-micron Ti-rich $Ti_4(Ni,Pt)_3$ intermetallic phase observed in a Ti-rich Ti-29.5Ni-20Pt (atom %) alloy containing approximately 1 atom % carbon after aging for 1024 hours at 500° C.

Figure 3:
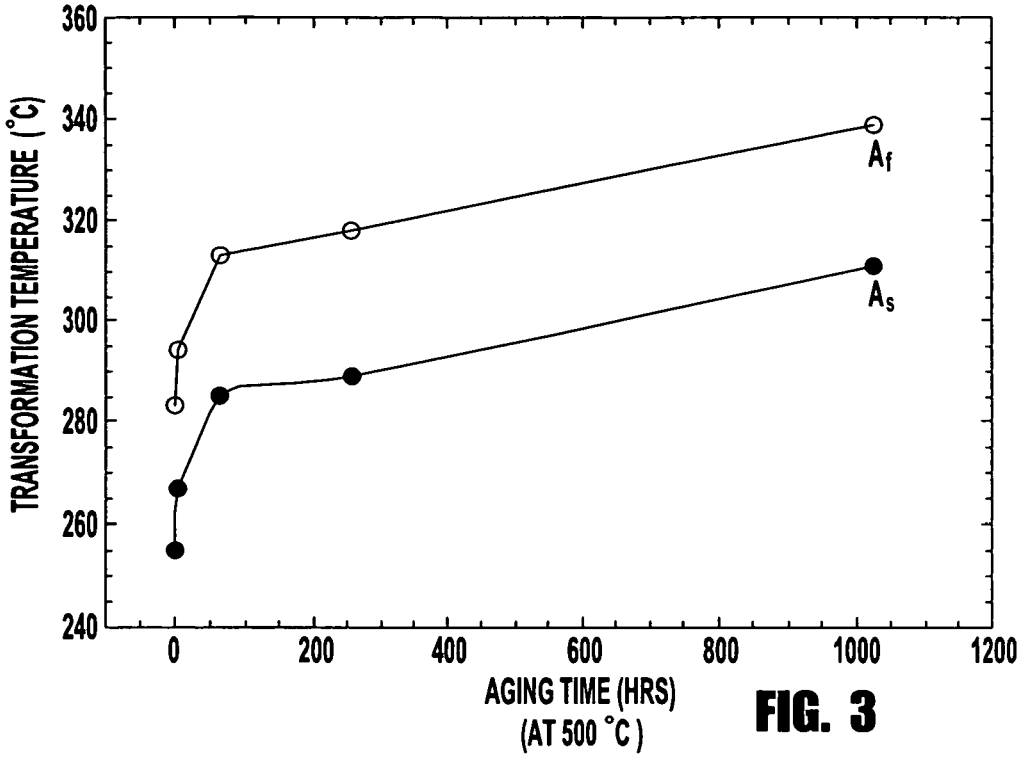

FIG. 3 is a curve showing aging of the induction melted Ti-rich Ti-29.5Ni-20Pt (atom %) alloy, containing sub-micron $Ti_4(Ni,Pt)_3$ precipitate phase. $A_s$ and $A_f$ are the austenite start and finish temperatures, respectively.

Figure 4:
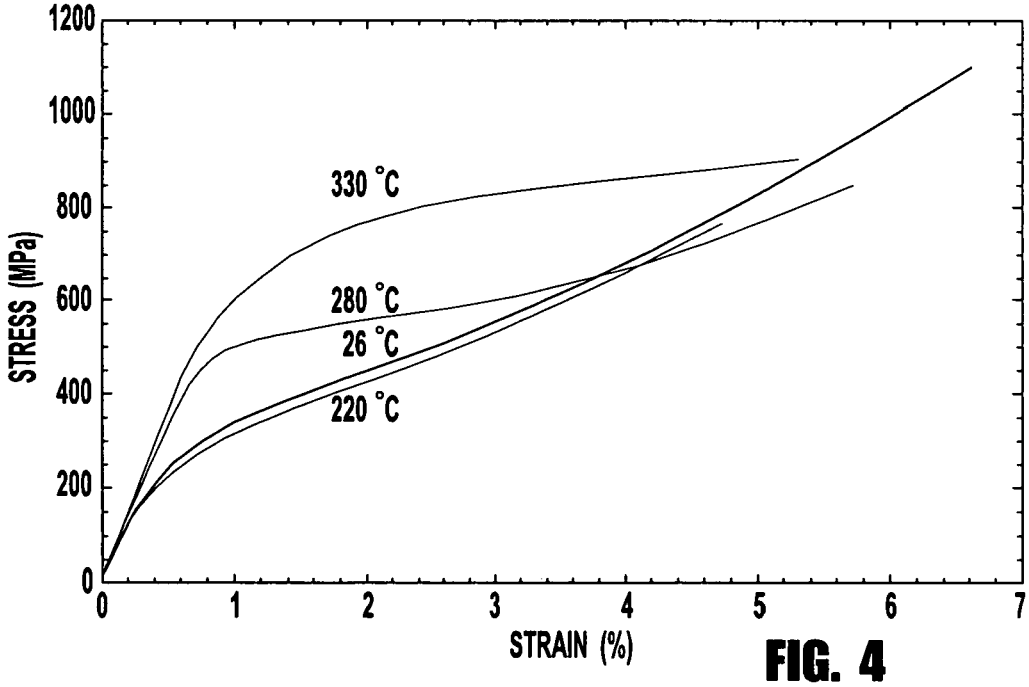

FIG. 4 is a curve showing tensile stress—strain behavior of an induction melted nominally Ti-29.5Ni-20Pt (atom %) alloy at various temperatures.

Figure 5:
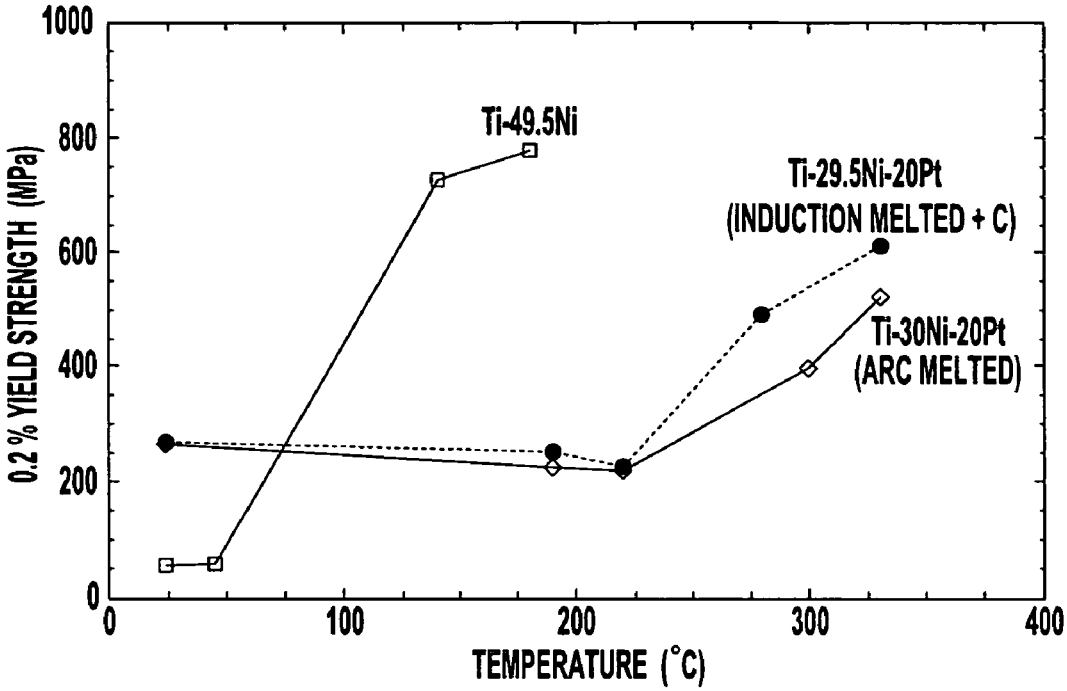

FIG. 5 is a curve showing the comparison of the yield stress versus temperature behavior for arc melted and induction melted Ti(Ni,Pt) alloys containing 20 atom % Pt and binary NiTi.

Figure 6:
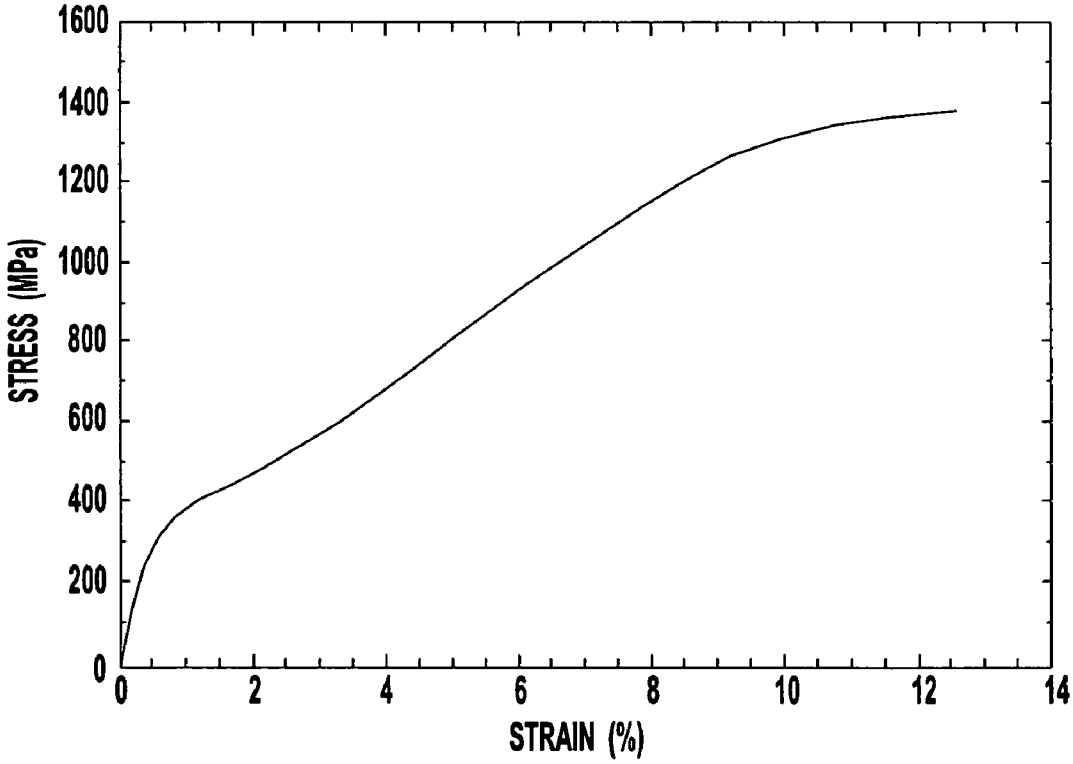

FIG. 6 is a curve showing the work output versus stress response for arc melted and induction melted Ti(Ni,Pt) alloys containing 20 atom % Pt, for binary NiTi, and for other Ti(Ni,Pt) alloys of higher Pt concentration.

Figure 7:
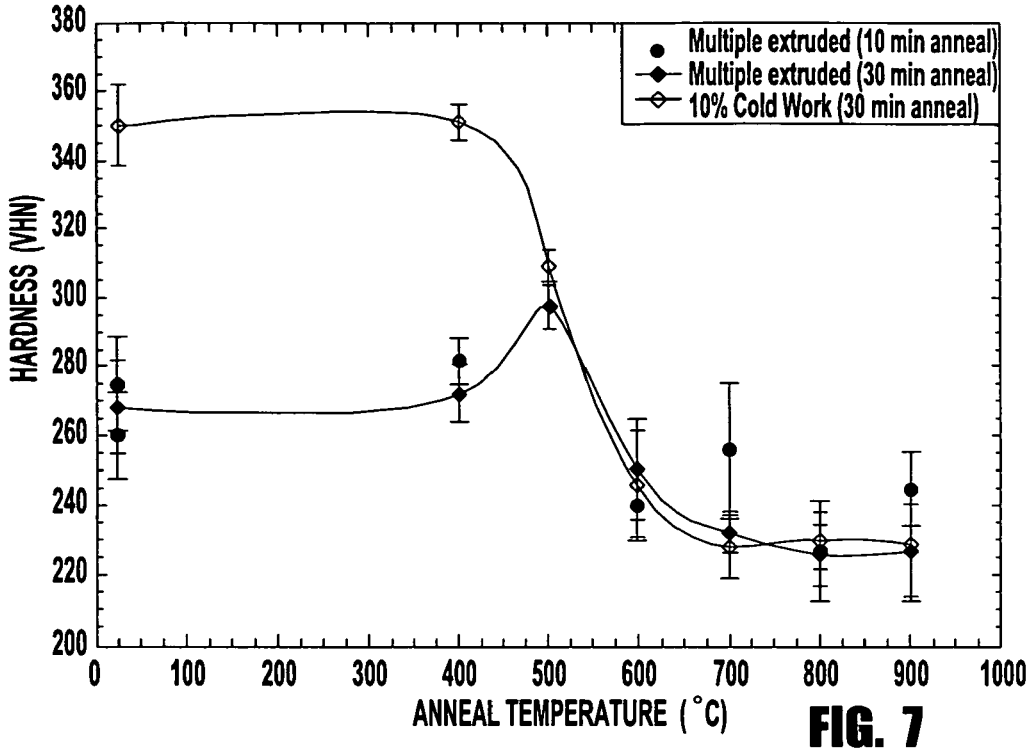

FIG. 7 is a curve showing the room temperature tensile stress-strain response for a Ti-29.5Ni-20Pt (atom %) alloy after thermomechanically processing it into a thin rod by a multiple extrusion technique.

Figure 8:
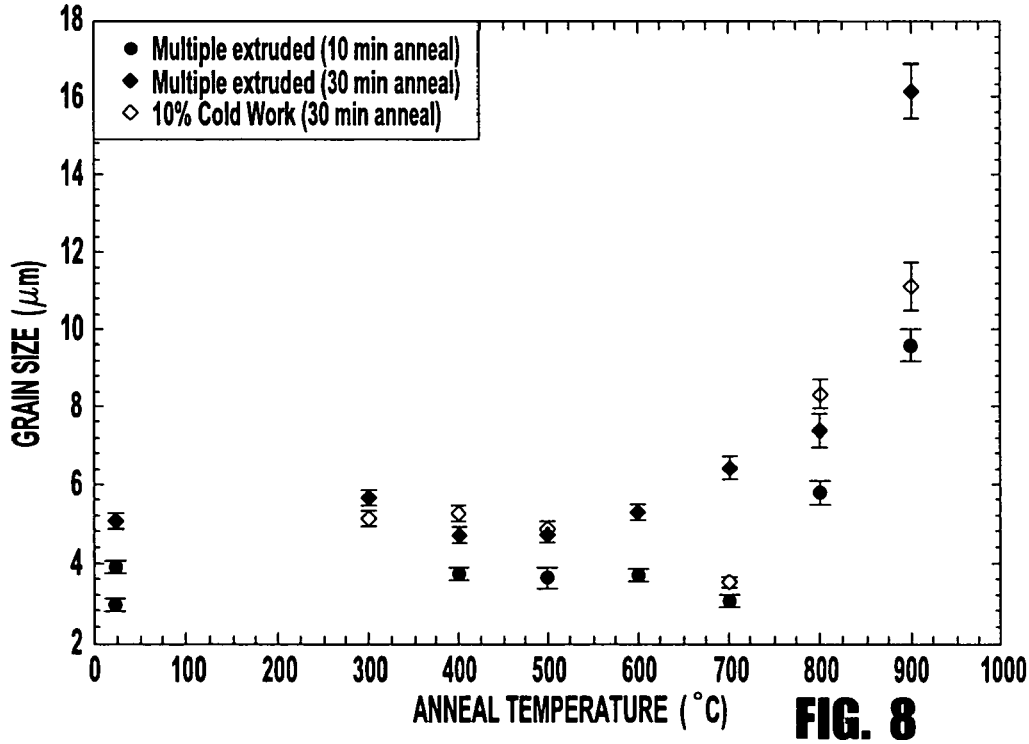

FIG. 8 is a chart showing the hardness versus annealing temperature for multiple-extruded and cold worked Ti-29.5Ni-20Pt.

Figure 9:
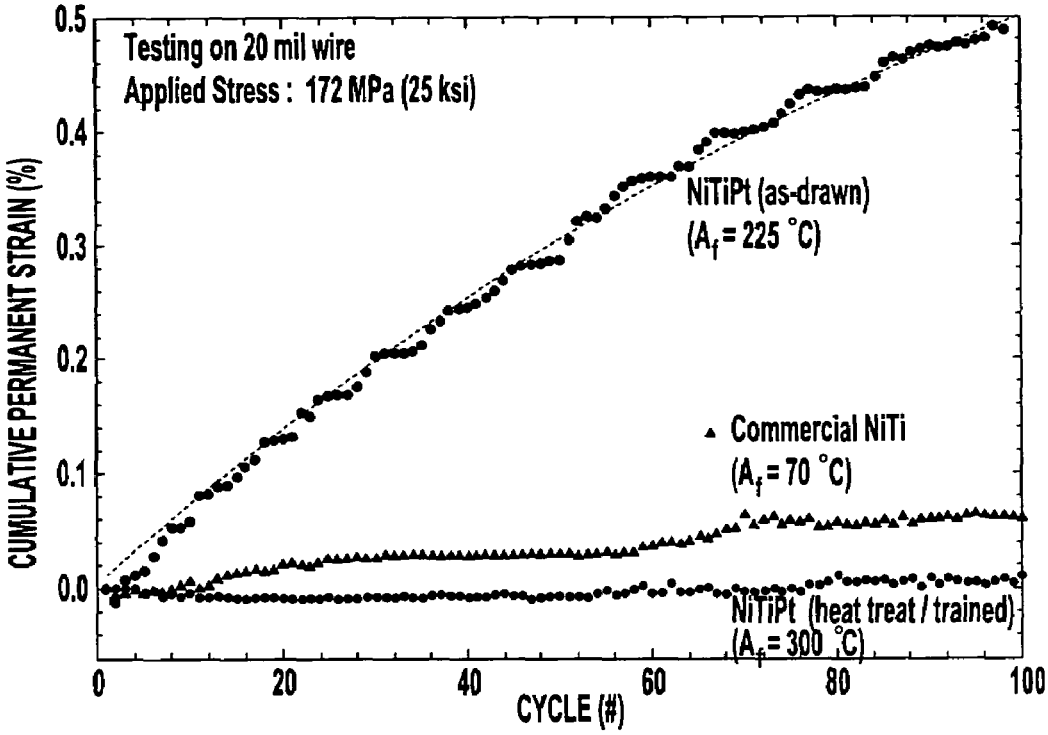

FIG. 9 is a curve showing the grain size versus annealing temperature for multiple-extruded and cold worked Ti-29.5Ni-20Pt.

Figure 10:
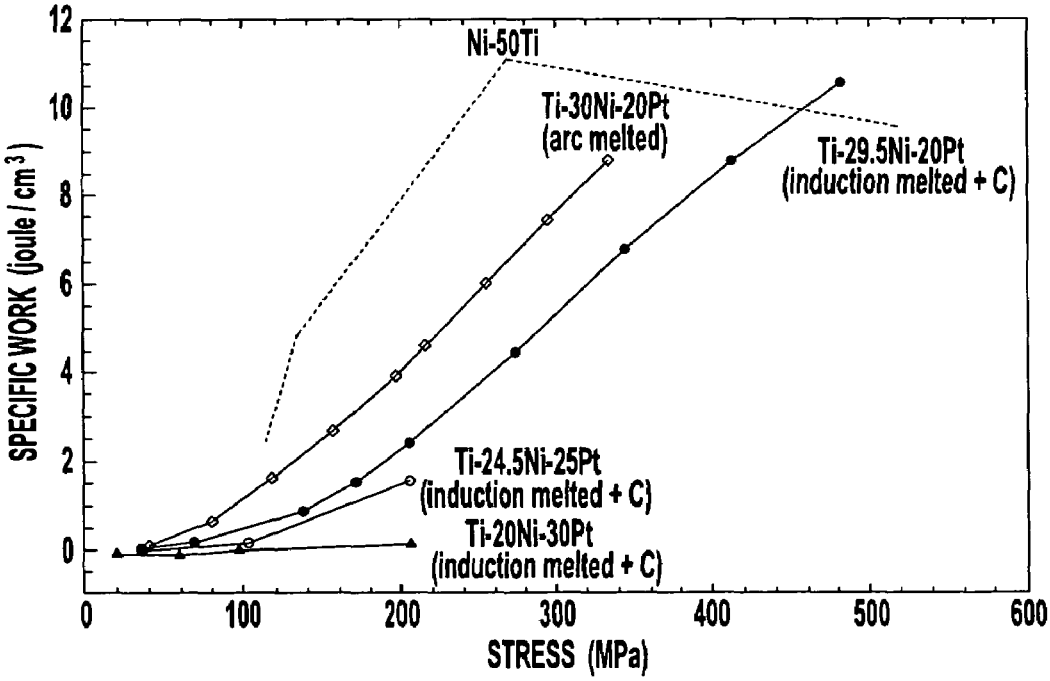

FIG. 10 is a curve showing the dimensional stability measured as cumulative permanent strain versus cycle number for 20 mil shape memory alloy wires cycled through their transformation temperatures under an applied stress of 172 MPa.

DETAILED DESCRIPTION OF THE PREFERRED EMBODIMENTS

The titanium rich, Titanium-Nickel-Platinum Shape memory alloys described in this invention will generally result in a two phase material consisting of a $Ti_2(Ni,Pt)$ phase within a Ti(Ni,Pt) matrix. The Ti(Ni,Pt) matrix is able to undergo a thermoelastic, martensitic transformation, but the $Ti_2(Ni,Pt)$ matrix forms as a coarse interdendritic structure during melting. The coarse, interdendritic structure is an undesirable phase that serves no benefit. The $Ti_2(Ni,Pt)$ phase tends to embrittle the alloy, makes thermomechanical processing very difficult, and lowers the fatigue life, the fracture strength, and the martensite volume fraction of the alloy. The formation of the $Ti_2(Ni,Pt)$ phase is not amenable to control through heat treatment. However, small amounts of this phase are tolerable by keeping the composition Ti-rich but fairly close to 50 atomic %. Such Shape memory alloys have stable transformation temperatures, reasonable tensile ductility, a narrow hysteresis, and most importantly high specific work output for use at high temperatures.

The transition temperatures are between about 100° C. and about 400° C. and preferably between about 200° C. and about 350° C. Above 400° C., the work output begins to approach zero.

The hysteresis is preferably less than about 50° C. Preferably the hysteresis is less than about 20° C. and most preferably between about 10° C. and about 20° C.

The maximum work output is at least about 5 J/cm$^3$. Preferably the work output is greater than about 10 J/cm$^3$. Most preferably, the work output is between about 10 J/cm$^3$ and about 15 J/cm$^3$.

These shape memory alloys have a wide range of compositions. Shape memory alloy compositions consist essentially of Ni, Pt, Ti, wherein the Ti content is between about 50 atomic % to about 52 atomic %, the Pt content is about 10 atomic % to about 25 atomic %, and the balance of the composition is Ni. The Ti content is preferably between about 50 atomic % to about 50.5 atomic % and most preferably between about 50.3 atomic % to about 50.6 atomic %. The Pt content is preferably between about 15 atomic % to about 23 atomic % and most preferably between approximately about 18.5 atomic % to about 21 atomic %. If desired, the compositions further including about 0 to 5 atomic % of one or more metals from the group consisting of Au, Pd and Cu. The latter metals would be used in place of a corresponding amount of Ni.

Moreover, the compositions of these Shape memory alloys can include less than about 2 atomic % of carbon. Preferably the carbon (C) content is between about 0.5 atomic % to about 1.0 atomic %. More preferably the C content is between about 0.6 atomic % to about 1.0 atomic %. The carbon would be used in place of a corresponding amount of Ni.

Variations on these alloys are also described herein. For example, the $Ti_2(Ni,Pt)$ phase can be significantly reduced in volume fraction or even eliminated by adding carbon (C) to the alloy during the melting process. The carbon can be added to the melt as powder, other solid forms, as CO gas, or by the process of melting the alloy in a graphite crucible. The $Ti_2(Ni,Pt)$ is stabilized by oxygen, and the presence of carbon or CO in the melt deoxidizes the alloy and reduces or eliminates the presence of this phase, resulting in an alloy consisting of fine micron size TiC particles and a submicron Ti-rich Ni—Ti—Pt intermetallic phase. Without being held to the details of the structure of this new, previously unreported, intermetallic phase, it is thought to be a low symmetry pseudo-trigonal or pseudo-hexagonal $Ti_4(Ni,Pt)_3$ phase. Regardless of the structure, this intermetallic phase is amenable to thermal control. Differential thermal analysis at a rate of 10° C./min indicates that the solvus peak temperature for this phase is 655° C., determined on heating. It has been experimentally verified that submicron size $Ti_4(Ni,Pt)_3$ precipitates are formed through various thermal processes such as slow cooling from elevated (>700° C.) temperatures or aging at temperatures between about 500° C. and 600° C.; even the coarsest particles are less than 300 nm in diameter.

The $Ti_4(Ni,Pt)_3$ precipitates provide several benefits:

1) The precipitates act to buffer the alloy matrix composition so that the high transformation temperatures of the alloy are maintained or increased with increased aging time;
2) The precipitate phase improves the yield strength, that is, the resistance of the austenite phase to deformation by dislocation processes, thus increasing the mechanical stability of the alloy at high temperatures; and
3) The precipitate phase increases the resistance of the martensite phase to deformation by dislocation processes, while still permitting deformation by twinning to occur quite readily. This enhances the stability of the martensite phase.

Taken together, these effects result in an alloy with greater potential work output and improved dimensional stability, reducing or eliminating the amount of plastic or permanent deformation that occurs during thermal cycling under load, especially at elevated temperatures.

In general, the Titanium-Nickel-Platinum alloys of the present invention can be produced by conventional melting practices, either by arc melting, induction melting or some variation such as vacuum arc remelting. One could also envision the processing of thin films of the disclosed alloy compositions by sputtering and other processes for use in various electronics and MEMs devices. Bulk compositional control of the metallic components is performed by weighing out the required percent of each element followed by melting and casting of the alloy. It is possible to introduce carbon (C) into the alloy during the melting process by using a graphite crucible, so that carbon additions to the melt are not necessary. Alternatively, carbon can be intentionally added during the melting practice as graphite or other forms, such as CO gas, to deoxidize and generate an alloy with a more specific carbon content.

In all cases, the cast ingots of Titanium-Nickel-Platinum alloys are homogenized. Appropriate treatments for these alloys include 1050° C. for 72 hours, followed by thermomechanical processing. These alloys are amenable to conventional thermo-mechanical practices including rolling, extrusion, swaging, forging, and drawing. A preferred method for fabricating thin rod and wire is with multiple hot extrusions at temperatures above 800° C., followed by centerless grinding to remove oxide and pickling products from the surface of the material. A preferred method for producing fine wire is cold drawing, followed by appropriate heat treatment and training processes.

As wrought processing will generally suppress the transformation temperature of the alloy, it is usually necessary to follow thermo-mechanical processing with a stress relief heat treatment at a temperature below the recrystallization temperature of the alloy. For Titanium-Nickel-Platinum alloys of the present invention, a typical stress relief treatment to fully recover the high-transformation temperature of the alloys would be about 10 to about 60 minutes at 600° C. Recrystallization and grain growth in these alloys does not occur until about 800° C. An alternate heat treatment is a brief 10 minute solutionizing anneal at 700° C., followed by aging at 600° C. for times ranging from 1-10 hours to introduce a fine second phase distribution of $Ti_4(Ni,Pt)_3$ precipitates. Multiple variations in these heat treatments are also possible.

The general nature of the invention having been described above, the following examples are presented as additional detail and illustrations thereof. It will be understood that the invention is not limited to these specific examples, but is susceptible to various modifications that are easily recognizable to those of ordinary skill and art.

Example 1

Arc Melted Plus Extruded Bar Stock

An ingot of nominal composition Ti-30Ni-20Pt (atom %) was prepared by vacuum, non-consumable-arc melting of high-purity starting components (99.95 Ti, 99.995 Pt, 99.98 Ni) using a water chilled copper crucible and non-consumable tungsten electrode. Since there is a large density difference between the three elements, the initial buttons of material were flipped and re-melted several times in order to insure complete melting and mixing of the constituents. The buttons were then formed into an ingot by drop casting them into a 12.7 mm diameter copper mold. The ingot was homogenized in vacuum at 1050° C. for 72 hours. After homogenization, the ingot was placed into a mild steel extrusion can, which was sealed and evacuated prior to extrusion at a 7:1 reduction ratio and 1100° C.

The final composition of the alloy, as measured by inductively coupled plasma emission spectroscopy, was Ti-30Ni-19.6Pt (atom %). The alloy consisted of approximately 2 vol. % $Ti_2(Ni,Pt)$ phase (5-10 microns in size) which was found to be iso-structural to the $Ti_2Ni$ phase commonly observed in Ti-rich NiTi alloys. In spite of the coarse grain size, the alloy had room temperature tensile ductility of approximately 4%.

In order to determine the work characteristics of the alloy, the strain versus temperature response of the alloy was determined for various constant load levels. The results are shown in FIG. 1. The solid curves represent strain versus temperature upon heating. The dashed curves are for cooling. Under a stress of 257 MPa, the strain recovery exceeded 2%, there was no significant permanent deformation, the repeatable work output was nearly 6 J/cm$^3$ at temperatures greater than 250° C., and the hysteresis was only about 10° C. Under a strain of 336 MPa, the work output was nearly 9 J/cm$^3$.

The yield strength of this material will be discussed immediately after describing the materials of Example 2 (below). The specific work output of this material and of the materials in the examples to follow will be discussed after describing the materials of Examples 3 and 4 (below).

Example 2

Induction Melted Plus Extruded Bar Stock everal ingots of nominal composition Ti-29.5Ni-20Pt (atom %) were prepared by vacuum induction melting of high-purity starting components (99.95 Ti, 99.995 Pt, 99.98 Ni). High purity, high density, graphite crucibles were used to contain the molten alloy during induction melting. The induction melter was equipped with a tilt pour capability and the molten melts were cast into a 25.4 mm diameter copper mold. The ingots were homogenized in vacuum at 1050° C. for 72 hours. After homogenization, the ingots were placed into mild steel extrusion cans, which were sealed and evacuated prior to extrusion at a 7:1 reduction ratio and 900° C.

The alloys contained between about 0.6 atom % and 1.0 atom % C. The alloy microstructures consisted of 0.5-2 micron size TiC particles and a submicron size $Ti_4(Ni,Pt)_3$ precipitate phase shown in the transmission electron micrograph of FIG. 2. In almost all cases, no $Ti_2(Ni,Pt)$ phase was observed, even though the starting composition of the alloys were more Ti-rich than the alloy described in Example 1.

Aging of the Ti-29.5Ni-20Pt material at 500° C. did not affect a change in the TiC volume fraction or particle size, but did increase the volume fraction of $Ti_4(Ni,Pt)_3$ phase with increasing aging time. It also resulted in an increase in the transformation temperature of the alloy (see FIG. 3). The largest benefit or change in transformation temperature occurred between 0 and 64 hours of aging at 500° C.

The tensile stress-strain behavior for the Ti-29.5Ni-20Pt alloy (as-extruded plus aged 1 hour at 500° C.) is shown in FIG. 4. Note how the stress-strain behavior changes between 220° C. and 280° C., but does not change between 26° C. (room temperature) and 220° C. Note that 26° C. is room temperature. The tensile ductility was good and the strain to failure was at least 5% at all temperatures, and over 6% at room temperature. The alloy is much stronger and stiffer at temperatures above the transformation temperature; in other words, when tested in the austenitic condition. The plateau in the stress-strain curve for the sample tested at 280° C. is indicative of stress-induced martensite, suggesting that this material is also capable of undergoing superelastic or at least pseudoelastic behavior at temperatures near 280° C. to about 300° C.

The tensile yield strength of the materials in examples 1 and 2 are compared to that of a conventional Ti-49.5Ni control material in FIG. 5. The control material was from Nitinol Devices Corporation, Fremont, Calif., as 9.63 mm diameter straightened SM495 rod. As with conventional NiTi alloys, there is a significant increase in yield strength as the temperature is increased and the alloy is transformed from martensite to austenite for the Ti—Ni—Pt alloys. In the austenitic condition (temperatures greater than 250° C.) the induction melted material containing the $Ti_4(Ni,Pt)_3$ phase (example 2) is stronger at equivalent temperatures than the arc melted material that contained only the $Ti_2(Ni,Pt)$ phase (example 1). But at lower temperatures, when the Ti—Ni—Pt alloys were tested in the martensitic condition, there was essentially no difference in strength. The fine $Ti_4(Ni,Pt)_3$ precipitate phase was responsible for strengthening the austenite phase against dislocation slip but had essentially no effect on the twinning stress of the material.

Example 3

Multiple-Extruded Rod

A pair of ingots of nominal composition Ti-29.5Ni-20Pt (atom %) were prepared by vacuum induction melting of high-purity starting components (99.95 Ti, 99.995 Pt, 99.98 Ni). High purity, high density, graphite crucibles were used to contain the molten alloy during induction melting. The induction melter was equipped with tilt pour capability and the molten melts were cast into a 25.4 mm diameter copper mold. The ingots were homogenized in vacuum at 1050° C. for 72 hours. After homogenization, the ingots were placed into mild steel extrusion cans, which were sealed and evacuated prior to extrusion. The ingots were extruded repeatedly, at temperatures between 800° C. and 1000° C. and area reduction ratios of 7:1 to 12:1, until the final diameter of the material was approximately 1.6 mm. The Ti-29.5Ni-20Pt alloy was removed from the extrusion can by pickling after each extrusion pass and placed in a new extrusion can prior to each additional extrusion run. In this manner, the diameter of the starting material was reduced from 25.4 mm to a final diameter of approximately 1.6 mm. After the last extrusion pass, the Ti-29.5Ni-20Pt rod was center-less ground to approximately 1.1 mm diameter in order to remove all the oxidation and pickling damage from the rod surface.

The tensile properties of the multiple-extruded Ti-29.5Ni-20Pt rod (FIG. 6) were significantly better than those of the single-pass extruded material (shown previously in FIG. 4). The ultimate tensile stress approached 1400 MPa and the fracture strain exceeded 12% (FIG. 6). As for work output, in practical terms, this 1.1 mm diameter rod is capable of repeatedly applying 45 kg of force without degradation in properties for thousands of cycles, and has therefore been used or targeted for use in several demonstration projects requiring a shape memory alloy with high transformation temperatures and capable of exerting high forces.

A piece of this multiple-extruded rod was cold worked at room temperature to a 10% reduction in area. This cold worked material along with the as-extruded rod was annealed for 10 and 30 minutes at various temperatures and the hardness and grain size measured in order to determine the recovery, recrystallization, and grain growth behavior of the material in order to establish appropriate annealing parameters for the Ti—Ni—Pt alloys. Recovery of the material starts at temperatures near 450° C. and is complete by about 700° C. for aging times between 10 and 30 min (FIG. 7). However, a peak in hardness is observed near 500° C., due to precipitation of the $Ti_4(Ni,Pt)_3$ phase as discussed above. Recrystallization and grain growth begins at about 800° C. (FIG. 8).

The high recrystallization and grain growth temperature (approximately 800° C.) is a definite advantage in these materials. It makes them amenable to heat treatment after thermomechanical processing, so that precipitation and stress relaxation heat treatments can be utilized after thermomechanical processing without adversely affecting grain size and mechanical properties. Also, because of the high recrystallization temperature, these alloys are ideal for use in applications where there is a possibility that the material would be subjected to significant over-temperature conditions during actuation or use. Such over temperature conditions would not degrade the microstructure or properties of the alloys of example 3.

Thermomechanical processing by multiple-extrusion was found to severely suppress the transformation temperatures in the material (Table 1). Therefore, based on our observations of the recrystallization and grain growth behavior, we applied a stress relaxation heat treatment of 30 min at 600° C. to recover the high transformation temperatures of the Ti-29.5Ni-20Pt (atom %) alloy which had been severely depressed after multiple extrusion. The transformation temperatures of the multiple-extruded rod in the as-processed condition and after annealing are shown in Table 1.

Table 1: Transformation temperatures and hysteresis of the multiple-extruded Ti-29.5Ni-20Pt (atom %) rod in the as-extruded condition and after heat treatment for 30 min at 600° C.

| Conditions | As (° C.) | Af (° C.) | Ms (° C.) | Mf (° C.) | Hysteresis |
|---|---|---|---|---|---|
| As-Received | 208 | 224 | 195 | 178 | 29° C. |
| Heat treated (600° C./30 mm) | 278 | 292 | 268 | 253 | 24° C. |

Example 4

Cold Drawn, Heat Treated, and Trained Wire

An ingot of nominal composition Ti-29.5Ni-20Pt (atom %) was prepared by vacuum induction melting of high-purity starting components (99.95 Ti, 99.995 Pt, 99.98 Ni). A high purity, high density, graphite crucible was used to contain the molten alloy during induction melting. The induction melter was equipped with tilt pour capability and the molten melt was cast into a 25.4 mm diameter copper mold. The ingot was homogenized in vacuum at 1050° C. for 72 hr and after homogenization, was placed into a mild steel extrusion can, which was sealed and evacuated prior to extrusion at a 7:1 reduction ratio and 800° C. After extrusion, the material was centerless ground to remove any surface damage left from the pickling process. The clean bar stock was then drawn through a series wire drawing dies of reduced diameter at room temperature followed after every couple of reductions by a stress relief treatment. In this manner, the alloy was processed into 0.5 mm diameter wire. The final wire reduction step resulted in a material with 30% cold work. The cold worked wire was then given a stress relief treatment of 30 min at 600° C., followed by an additional thermomechanical or "training" treatment used to optimize the transformation strain in the wire and increase the resistance of the wire to plastic deformation during repeated cycling, which is a problem in most shape memory alloys when used above room temperature. This treatment consisted of 10-30 thermal cycles through the transformation temperature of the alloy while under a constant stress of 345 MPa.

After the post-drawing heat treatment and training, the behavior of the Ti-29.5Ni-20Pt (atom %) wire was extremely stable. The transformation temperatures were 285° C. and 300° C. for the martensite start and austenite finish temperatures, respectively. These transformation temperatures were also stable and did not change even after repeated thermal exposure to temperatures as high as 450° C. The hysteresis is narrow, just 15° C., making the material ideal for actuator applications requiring active control. The transformation strain at 172 MPa is about 1.5% and the corresponding work output at this stress level is approximately 2.5 $J/cm^3$. After training, the Ti-29.5Ni-20Pt (atom %) wire also displayed excellent dimensional stability during repeated actuation against a bias stress of 172 MPa, (as shown in FIG. 9). In fact, the trained Ti-29.5Ni-20Pt alloy is dimensionally more stable after repeated actuation than commercial "high-temperature" NiTi alloys, even though there is a 230° C. difference in transformation temperature (potential operating temperature). This dimensional stability or resistance to changes in length during use is critical for applications requiring repeated cycling, in order to minimize drifting of the zero point in SMA actuators and for long fatigue life.

The specific work output as a function of stress for the various examples and for a conventional binary TiNi control alloy are shown in FIG. 10. Overall, both NiTiPt materials have very good specific work output. The 20Pt arc melted material (see example 1) is capable of greater work output for a given stress level than the 20Pt induction melted alloy (see example 2). However, the induction melted alloy is capable of handling significantly higher stresses overall, and has a higher maximum work output value. The 20Pt arc melted material would probably be preferred in lower stress applications that required larger deflection or strains. The induction melted material would be preferred in high force situations. While higher Pt levels result in higher transformation temperatures, their work output is seriously diminished as shown in FIG. 10, making such alloys inappropriate in high force applications.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described alloy compositions, the terms (including a reference to a "means") used to describe such alloy compositions are intended to correspond, unless otherwise indicated, to any alloy composition which performs the specified function of the described alloy composition (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

We claim the following:

1. Shape memory alloy compositions consisting essentially of:

from about 50 atomic % to about 52 atomic % of Ti, approximately 10 atomic % to 25 atomic % of Pt, and the balance of Ni; and said compositions further including C wherein the C would replace a corresponding amount of Ni; and wherein the C content is between about 0.5 atomic % to about 2 atomic %.

2. High work output shape memory alloy compositions as in claim 1, said compositions further including less than about 5 atomic % of one or more metals from the group consisting essentially of Au, Pd and Cu wherein the one or more metals would replace a corresponding amount of Ni.

3. High work output shape memory alloy compositions as in claim 1 wherein the Ti content is approximately 50 atomic % to about 50.5 atomic % and the Pt content is approximately 15 atomic % to about 23 atomic %.

4. High work output shape memory alloy compositions as in claim 1 having a transition temperature is between about 100° C. and about 400° C.

5. The high work output shape memory alloy compositions as in claim 4 wherein the transition temperature is between about 200° C. and about 350° C.

6. High work output shape memory alloy compositions as in claim 1 having a hysteresis preferably less than about 50° C.

7. The high work output shape memory alloy compositions as in claim 6 wherein the hysteresis is preferably less than about 20° C.

8. The high work output shape memory alloy compositions as in claim 7 wherein the hysteresis is preferably between about 10° C. and about 20° C.

9. High work output shape memory alloy compositions as in claim 1 wherein the maximum work output is greater than about 10 J/cm3.

10. The high work output shape memory alloy compositions as in claim 9 wherein the maximum work output is preferably between about 10 J/cm3 and about 15 J/cm3.

11. Shape memory alloy compositions consisting essentially of:

from about 50 atomic % to about 52 atomic % of Ti, approximately 10 atomic % to 25 atomic % of Pt, and the balance of Ni;

said compositions further including less than about 5 atomic % of one or more metals from the group consisting essentially of Au, Pd and Cu wherein the one or more metals would replace a corresponding amount of Ni; and said compositions further including C wherein the C would replace a corresponding amount of Ni; and wherein the C content is between about 0.5 atomic % to about 2 atomic %.

12. High work output shape memory alloy compositions as in claim 11 wherein the Ti content is between about 50.3 atomic % to about [50.6] 50.5 atomic %, the Pt content is between about 18.5 atomic % to about 21 atomic %, and the C content is between about 0.6 atomic % to about 1 atomic %.

* * * * *